US007004226B2

(12) United States Patent
Östlund et al.

(10) Patent No.: US 7,004,226 B2
(45) Date of Patent: Feb. 28, 2006

(54) APPARATUS FOR CONTINUOUS CASTING OF METAL STRIPS

(75) Inventors: Sture Östlund, Valstorpsvägen (SE); Patrik Sivesson, Vidargatan (SE)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/500,345

(22) PCT Filed: Dec. 18, 2002

(86) PCT No.: PCT/FI02/01036

§ 371 (c)(1),
(2), (4) Date: Jun. 24, 2004

(87) PCT Pub. No.: WO03/055621

PCT Pub. Date: Jul. 10, 2003

(65) Prior Publication Data

US 2005/0061469 A1 Mar. 24, 2005

(30) Foreign Application Priority Data

Dec. 28, 2001 (FI) ..... 20012582

(51) Int. Cl.
*B22D 11/00* (2006.01)

(52) U.S. Cl. ..... 164/418; 164/459; 164/444

(58) Field of Classification Search ..... 164/418, 164/459, 487, 444
See application file for complete search history.

(56) References Cited

U.S. PATENT DOCUMENTS

| | | | | |
|---|---|---|---|---|
| 3,381,741 | A * | 5/1968 | Gardner | 164/472 |
| 3,435,881 | A | 4/1969 | Smith et al. | 164/283 |
| 3,797,555 | A | 3/1974 | English | 164/89 |
| 3,905,418 | A | 9/1975 | Watts | 164/260 |
| 4,300,621 | A * | 11/1981 | Wilson | 164/485 |
| 6,427,757 | B1 * | 8/2002 | Tilak | 164/418 |

FOREIGN PATENT DOCUMENTS

| | | |
|---|---|---|
| GB | 2 034 218 | 6/1980 |
| WO | WO 00/33991 | 6/2000 |

* cited by examiner

*Primary Examiner*—Kuang Y. Lin
(74) *Attorney, Agent, or Firm*—Morgan & Finnegan, LLP

(57) ABSTRACT

Apparatus for continuous vertical casting of metal strips, comprising: a mould (10) having top and bottom ends an open-ended mould cavity (C), a tundish (11) having a discharge opening (11A) in direct communication with the mould cavity (C) to feed molten metal into a mould entrance opening (E) past an interface between the tundish (11) and the mould (10); a sealing device (14) forming a seal at said tundish-mould interface to prevent molten metal from entering said interface, and a device (12) for supplying molten metal to the tundish (11) and maintaining a level of molten metal therein. The scaling device (14) comprises a pair of flat horizontal surfaces (10A, 11B), one on the mould around the entrance opening (E) and one on the tundish (10) around the discharge opening (11A), and a sealing element (14A) formed of a sheet of graphite and being in constant sealing engagement with both said surfaces (10A, 11B).

5 Claims, 4 Drawing Sheets

APPARATUS FOR CONTINUOUS CASTING OF METAL STRIPS

BACKGROUND OF THE INVENTION

This invention relates to apparatus for continuous vertical casting of metal strips and more particularly to apparatus of the kind comprising: a mould having top and bottom ends an open-ended mould cavity with a mould entrance opening at the top end and a strip exit opening at the bottom end, a tundish for holding molten metal, said tundish having a discharge opening in direct communication with the mould cavity to feed molten metal into the mould entrance opening past an interface between the tundish and the mould, a sealing device forming a seal at said tundish-mould interface to prevent molten metal from entering said interface, and a molten-metal feeding device for supplying molten metal to the tundish and maintaining a level of molten metal therein.

U.S. Pat. No. 3,797,555 A discloses continuous-casting apparatus of this kind. An important feature of such apparatus is that the mould has what is often referred to as a hot top, meaning that the level of the surface of the molten metal within the casting apparatus is substantially higher, namely within the tundish, than the level where the solidification of the molten metal against the chilled walls of the mould cavity is initiated.

In hot top continuous-casting apparatus there is thus a contiguous body of molten metal extending from some level within the tundish down to a level lower than the level within the mould cavity where solidification of the molten metal is initiated. Accordingly, there is no point within the mould cavity where the atmosphere can interfere with the solidification of the metal. Another advantage of the hot top casting technique is in the higher metallostatic pressure resulting from having the level of the molten metal in the tundish, rather than somewhere within the mould.

For the reliable operation of the casting apparatus and maintenance of a high quality of the cast, it is necessary to provide a reliable sealing at the tundish-mould interface, that is, at the point where the molten metal continuously fed into the mould flows through the discharge opening of the tundish and enters the mould cavity. Providing a reliable sealing is particularly difficult in casting apparatus where the mould is oscillated to facilitate the movement of the solidified metal through the mould cavity. It is also difficult to provide the large sealing surfaces, which are essential for a reliable sealing.

BRIEF SUMMARY OF THE INVENTION

An object of the invention is to provide a reliable sealing device at the tundish-mould interface in casting apparatus of the kind described above.

In accordance with the invention a continuous-casting apparatus of the kind indicated initially is characterised in that the sealing device comprises: an upwardly facing horizontal flat sealing element support surface on the mould at the top end thereof, said sealing element support surface extending about the mould entrance opening, a flat downwardly facing surface on the tundish, said downwardly facing surface extending about the discharge opening of the tundish, and a sealing element formed of a sheet of graphite and being in constant sealing engagement with both said horizontal sealing element support surface on the mould and said downwardly facing surface of the tundish, said sealing element extending about the mould entrance opening and the discharge opening of the tundish.

In the apparatus according to the invention, the sealing at the tundish-mould interface is accomplished by means of a very simple and inexpensive sealing device with a sealing element interposed between a pair of flat horizontal surfaces, one on the tundish and the other on the mould. The tundish and the metal it holds apply the pressure required for the sealing. If the mould is oscillated vertically, the tundish can easily be arranged to oscillate together with the mould. If the mould is additionally oscillated horizontally, the horizontal oscillations need not include the tundish, because the tundish and the mould can slide horizontally relative to one another on the sealing element without impairing the sealing effect of the sealing device.

The invention will be described in greater detail below with reference to the accompanying drawings in which an embodiment of the continuous-casting mould according to the invention is diagrammatically illustrated.

DETAILED DESCRIPTION OF THE INVENTION

Figure 1:
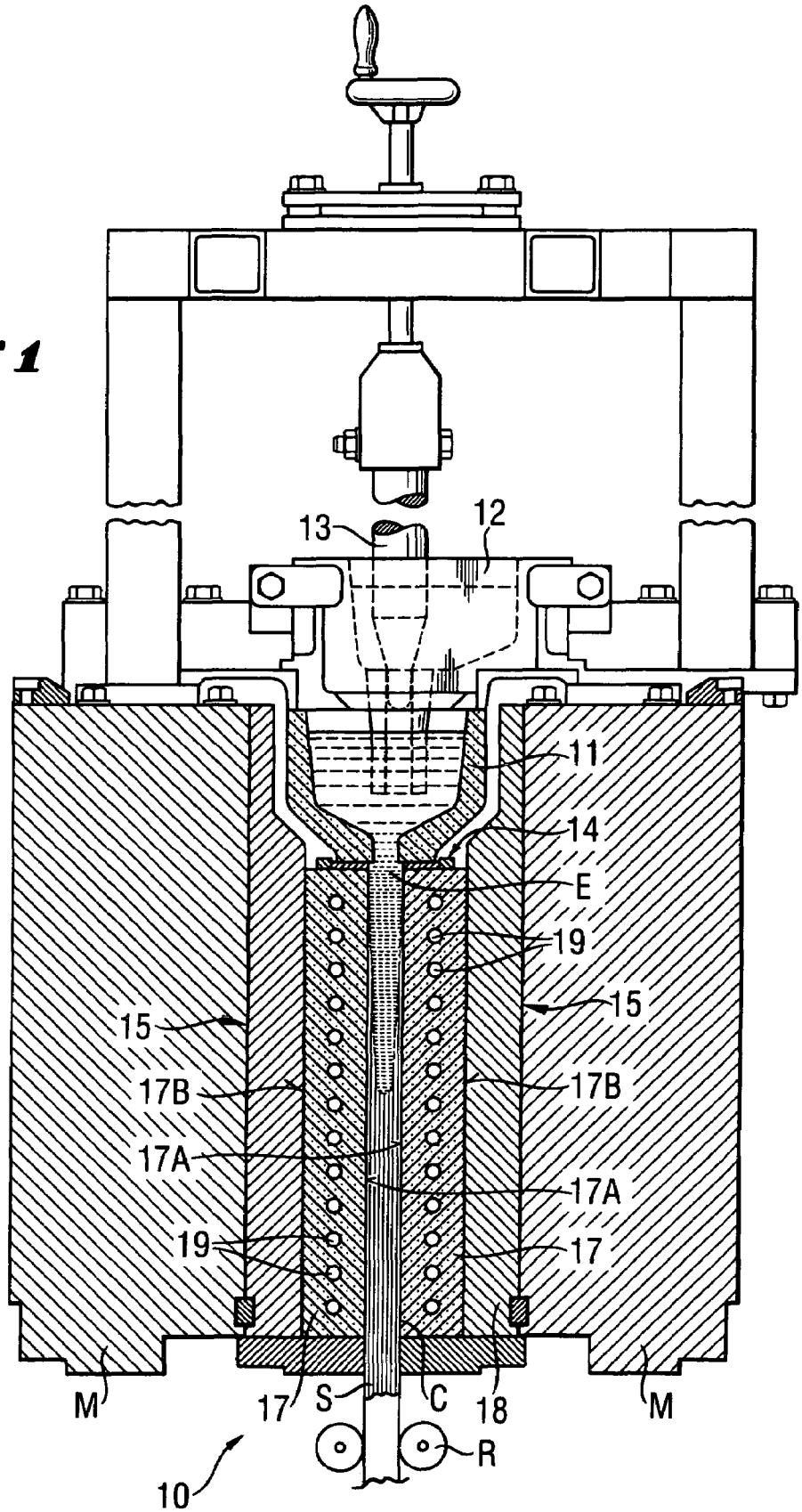
FIG. 1 is a view in vertical section along line I—I of FIG. 2 of a continuous-casting apparatus embodying the invention, the apparatus including a mould and a tundish with associated means for supplying molten metal.

In the embodiment of the invention shown by way of example in the drawings, a continuous-casting mould 10 is used for the vertical casting of metal strips, especially strips of non-ferrous metals or alloys, such as copper and copper base alloys. Molten metal to be cast in the mould 10 is continuously fed from a feed head or tundish 11 into a vertically extending mould cavity C through a rectangular elongate mould entrance opening E at the top end of the mould. As the metal proceeds downwardly in the mould cavity, it solidifies to form a solid strand in the shape of a strip S that exits through a discharge opening at the bottom end of the mould. Beneath the mould 10 the solidified strip S passes between withdrawal rolls R, which operate to withdraw the strip from the mould at a constant rate.

The tundish 11 receives the molten metal from a furnace (not shown) through a launder 12 (only partially shown) including a conventional stopper rod 13 for controlling the flow into the tundish such that a substantially fixed level of molten metal is maintained in the tundish. This flow control can be carried out using conventional techniques and need not be described.

More particularly, the molten metal is fed into the mould 10 through a rectangular outlet opening 11A which is formed in the flat, horizontal bottom side 11B of the tundish 11 and substantially coextensive with the mould entrance opening E. As will be described in more detail below, the tundish 11 rests on a flat, horizontal top surface 10A of the mould 10 through the intermediary of a sealing device 14. This sealing device serves to prevent the molten metal from escaping laterally at the tundish-mould interface formed by the said top surface 10A of the mould and the said bottom surface 11B of the tundish 11, i.e. that flat horizontal surface that surrounds the outlet opening 11A.

Figure 2:
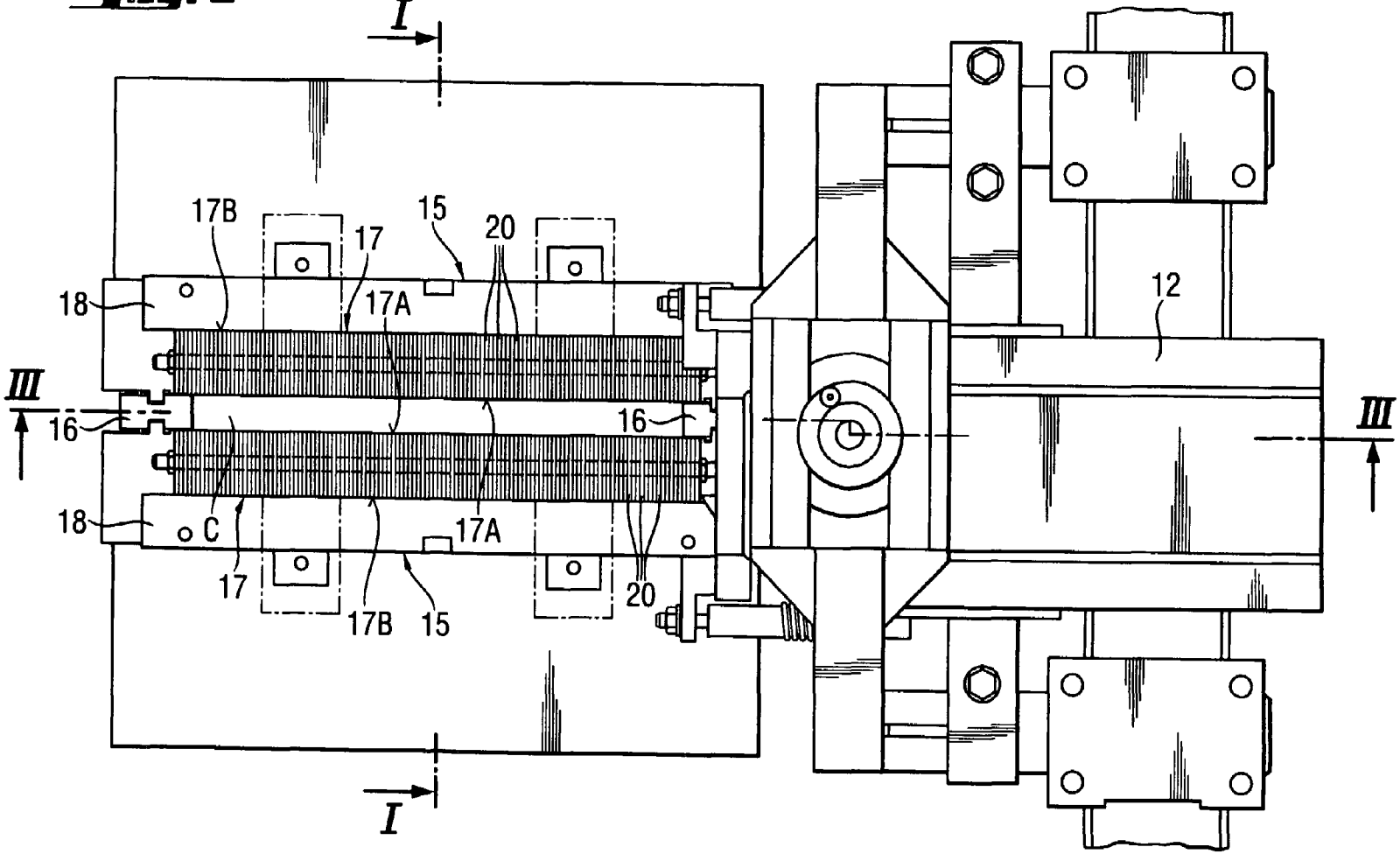
FIG. 2 is a plan view of the apparatus shown in FIG. 1 with the portion of the tundish overlying the mould omitted.

In operation of the illustrated continuous-casting apparatus, the mould 10 is mounted between a pair of mounting blocks M of a casting machine, which may be of conventional design. The mould 10 proper comprises a pair a pair of spaced-apart wide side walls, generally designated by 15, and a pair of narrow end walls 16 formed of a pair of graphite bars and bridging the gap between the confronting inner sides of the side walls 15 so that the side and end walls 15, 16 jointly define the mould cavity C. FIG. 2 clearly shows the rectangular shape of the mould cavity C as viewed in the direction the cast metal moves through the passage formed by the mould cavity.

The sidewalls 15 are substantially identical in design. Each side wall comprises two main parts, namely a parallelepiped graphite slab or block 17 one face of which, the inner face 17A, is directed toward the mould cavity C and the opposite or outer face 17B of which is directed away from the mould cavity, and a backing plate 18 which is secured to the mounting blocks M and supports and protects the graphite block 17. The backing plate 18 covers the entire outer face of the graphite block 17 and also engages the ends thereof. The graphite block 17 and its construction is unique and will be described in detail below, whereas the backing plate 18 may be of a substantially conventional design and need not be further described.

Figure 3:
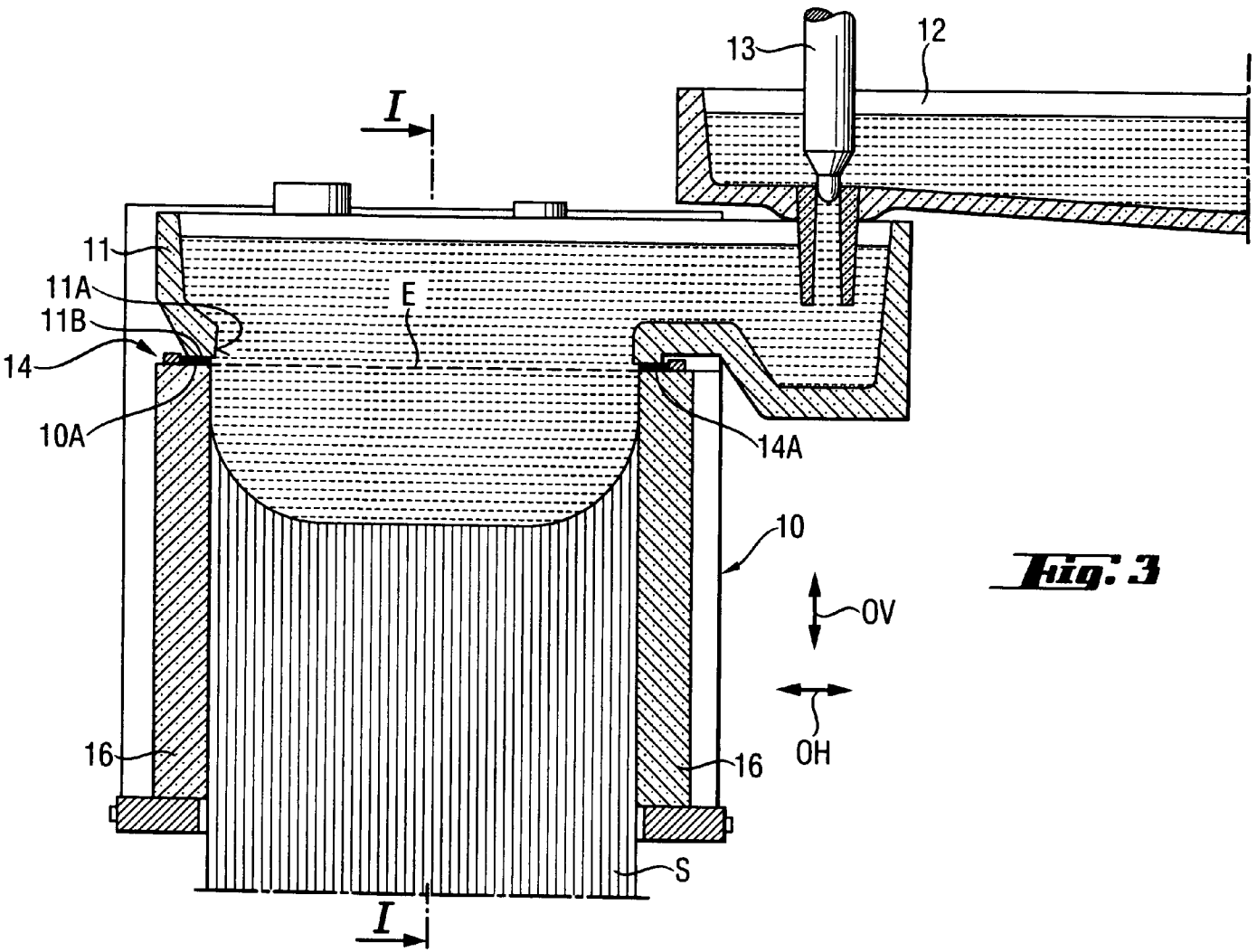
FIG. 3 is a view in vertical section along line III—III of FIG. 2.

In operation of the illustrated continuous-casting apparatus, the mould 10 is oscillated at least in the vertical direction, that is, in the direction of movement of the metal being cast as is indicated by a double arrow OV in FIG. 3. Preferably, it is also oscillated horizontally as indicated by a double arrow OH so that there is a horizontal oscillatory relative movement of the mould 10 and the tundish parallel longitudinal direction of the mould entrance opening E. The oscillation or oscillations may be effected by any suitable mechanism. Several types of mechanisms for mould oscillation are known in the continuous-casting art.

Since the tundish 11 constantly rests on the sealing element 14A, it has to have some movability in the vertical direction relative to the frame of the casting apparatus to allow the vertical oscillations without the sealing element 14A losing its sealing effect. Horizontal oscillations can be accommodated by the horizontal sliding movements of the mould 10 and the tundish 11 relative to one another that are readily permitted by the sealing member 14A.

Associated with each sidewall 15 is a cooling system, which is largely conventional except for a part thereof. That part is included in the graphite block 17 and comprises an array of parallel, coolant tubes 19 of metal, such as copper. Other parts (not shown) of the system include means incorporated in the backing plates 18 for passing a liquid coolant through the coolant tubes 19 in the graphite block 17. As shown in the drawings, the tubes extend horizontally—that is, transversely to the direction in which the cast metal moves through the mould cavity C—between opposite ends of the graphite block 17 along a vertical plane approximately centrally between the vertical large faces of the graphite blocks 17.

The graphite block 17 of each side wall 15 is formed of a large number of thin strip-like rectangular elongate, thin (thickness e.g. about 1 mm) graphite sheets or laminae 20 which are stacked with their broad surfaces or faces in engagement with one another and their narrow longitudinal surfaces or edges jointly forming the broad sides or faces of the parallelepiped slab-like straight stack or graphite block 17 so formed. The inner face 17A of the graphite block 17 mounted in the mould 10 forms one of the sides of the mould cavity C.

Preferably, the laminae 20 are made from flaky graphite, that is, graphite made up essentially of compacted flakes which are oriented such that they extend in planes substantially parallel to the faces of the graphite sheets from which the laminae are cut. Graphite sheets (foils and plates) of that kind are readily available as commercial products. A particular attraction of such graphite sheets is that their thermal conductivity in directions parallel to the faces is considerably better than their thermal conductivity perpendicular to the faces. Examples of commercially available graphite sheet products that are suitable for the graphite block 17 are marketed by Sigri Elektrografit GmbH, Meitingen bei Augsburg, Germany, under the designations SIGRAFLEX-F (foils) and SIGRAFLEX-L (plates).

To achieve as favourable heat conducting properties as possible, it is desirable that the density of the graphite making up the laminae be as high as possible. It may be advantageous, therefore, to increase the density of the commercially available sheets of flaky graphite by subjecting the sheets, or the laminae cut from them, to a densifying treatment, such as by rolling, before the stacks are formed.

Before the graphite block 17 is formed by stacking the laminae 20, apertures are formed, e.g. punched, in the laminae to allow for reception of the coolant tubes 15. The size of the apertures should be accurately matched with the size of the coolant tubes 19 so that a snug fit of the tubes in the apertures is achieved. Such a fit is essential to obtain an efficient heat transfer from the graphite to the liquid coolant flowing in the coolant tubes.

A convenient procedure for forming the stack from the apertured laminae 20 is to secure one end of the coolant tubes 19 to an end member (not shown), preferably a rectangular metal plate of approximately the length and width of the laminae 20, such that the tubes extend in accurately parallel relation, and then sliding the laminae 20 over the opposite ends of the tubes and pushing them along the tubes until they are in face-to-face engagement with one another. When all laminae 20 required to form the stack have been added, a similar end member is applied to the stack and pressure is applied in opposite directions through the end members to compact the stack and the laminae 20 forming the stack. Such compaction enhances the contact of the laminae with the coolant tubes 19 and thereby promotes the heat transfer from the laminae 20 to the coolant flowing in the tubes.

Following the above-described assembly of the graphite block 17 with the coolant tubes 19 accommodated in it, the large faces 17A, 17B of the graphite block are machined, such as by milling, so that the graphite block is reduced to the proper accurate dimensions and will have smooth surfaces. The block 17 so finished block is then mounted to its backing plate 18, whereupon the side wall 15 formed by the graphite block 17 and the backing plate 18 is installed in the casting machine.

In the installed position of the side and end walls 15, 16, the flat, horizontal upper end surfaces of the blocks 17 and the end walls 16 form the top surface 10A which extends about the mould entrance opening E. The top surface 10A supports a flat sealing element 14A, which in operation of the continuous-casting apparatus forms the sealing device 14 together with the mould surface 10A and the tundish surface 11A, opposite sides of the sealing element 14 then being in sealing engagement with these surfaces.

The sealing element 14A is fabricated from a graphite sheet material similar to or identical with the graphite sheet material from which the laminae 20 of the graphite block 17 are made. In the illustrated embodiment the sealing element 14A comprises only a single sheet or layer, but it may alternatively comprise a plurality of superposed sheets or layers.

Figure 1A:
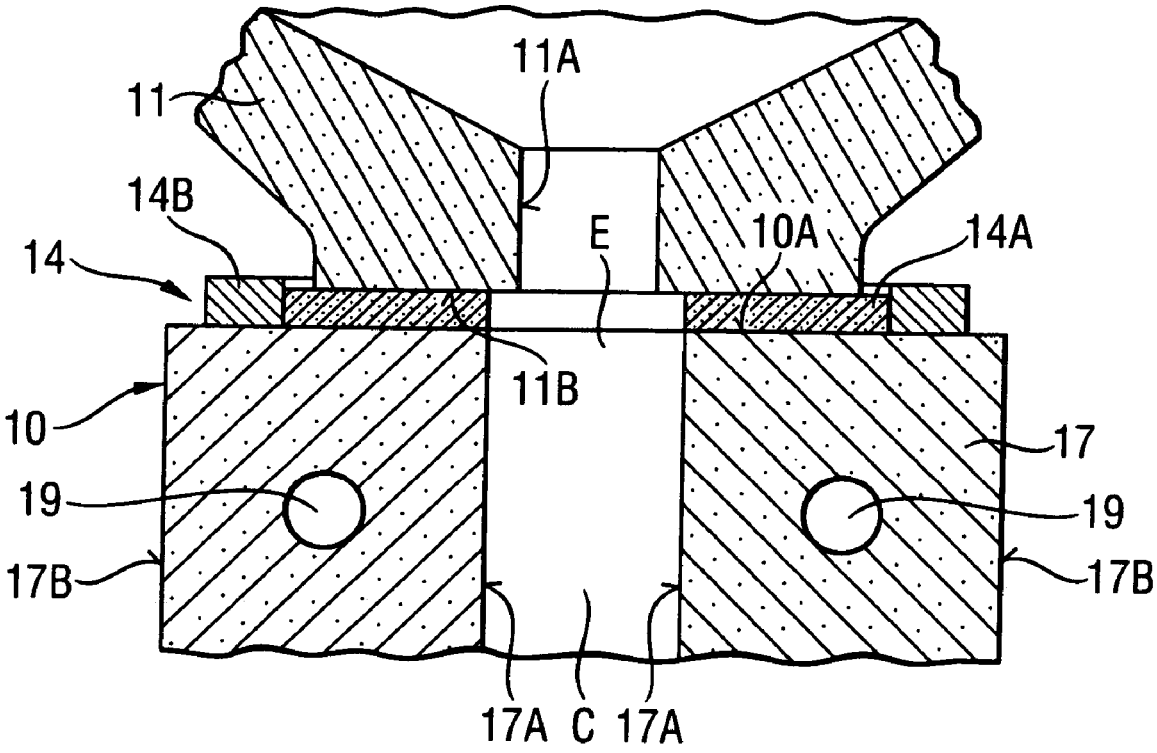
FIG. 1A shows a portion of FIG. 1 drawn to a larger scale to more clearly illustrate the lower portion of the tundish and the upper portion of the mould as well as an interposed sealing device.

Naturally, the sealing element 14A has to be mounted on the tops surface 10A or, alternatively, the bottom surface 11 B of the tundish 11 such that in operation of the casting apparatus the sealing member will be retained in the proper sealing position with its faces in sealing engagement with the mould surface 10A and the bottom surface 11B of the tundish 11. Several methods and means for retaining the sealing element 14A in the proper position are feasible. The presently preferred retaining means is that illustrated in FIG. 1A and comprises a frame 14B, e.g. of copper, which is secured to the top surface 10A of the mould 10 to confine and retain the sealing element 14A.

As indicated above, the sealing device 14 may comprise a plurality of sealing elements similar to the illustrated sealing element 14A. For example, in addition to the illustrated sealing element 14A positioned on the top surface 10A of the mould 10 a similar sealing element may be provided and fastened to the bottom surface 11B of the tundish 11 so that in operation it will slidably and sealingly engage the first-mentioned sealing element 14A.

In the illustrated embodiment, the tundish 11 is positioned in a recess formed between the upper portions of the mould surface walls 15. This positioning of the tundish is of no particular significance in the context of the invention.

What is claimed is:

1. Apparatus for continuous vertical casting of metal strips, comprising a mould having top and bottom ends, an open-ended mould cavity with a mould entrance opening at the top end and a strip exit opening at the bottom end, a tundish for holding molten metal, said tundish having a discharge opening in direct communication with the mould cavity to feed molten metal into the mould entrance opening past an interface between the tundish and the mould, a sealing device forming a seal at said tundish-mould interface to prevent molten metal from entering said interface, and a molten-metal feeding device for supplying molten metal to the tundish and maintaining a level of molten metal therein, said sealing device comprises an upwardly facing horizontal flat sealing element support surface on the mould at the top end thereof, said sealing element support surface extending about the mould entrance opening, a flat downwardly facing surface on the tundish, said downwardly facing surface extending about the discharge opening of the tundish, and a sealing element formed of a sheet of graphite and being in constant sealing engagement with both said horizontal sealing element support surface on the mould and said downwardly facing surface of the tundish, said sealing element extending about the mould entrance opening and the discharge opening of the tundish, wherein the mould comprises a pair of side walls, each side wall comprises a vertical graphite block formed from a stack of elongate graphite laminae and one end of said block forms part of said sealing element support surface of the mould.

2. Apparatus according to claim 1, wherein the graphite laminae of the stack extend from the entrance opening of the mould cavity to the exit opening and wherein said part of the sealing element support surface on the mould is formed by the ends of the laminae.

3. Apparatus according to claim 2, wherein a plurality of coolant tubes extend horizontally through the graphite block through apertures formed in the graphite laminae.

4. Apparatus according to, claim 1 wherein the mould further comprises a pair of end walls of graphite which bridge gaps between a pair of side walls, each of said side walls comprises a vertical graphite block, said end walls having flat horizontal upper end faces which are level with one end of each of said graphite blocks and form parts of said sealing element support surface on the mould.

5. Apparatus according to, claim 1 wherein said downwardly facing surface of the tundish is slidable with respect to the sealing element.

* * * * *

UNITED STATES PATENT AND TRADEMARK OFFICE

CERTIFICATE OF CORRECTION

PATENT NO. : 7,004,226 B2
APPLICATION NO. : 10/500345
DATED : February 28, 2006
INVENTOR(S) : Sture Östlund and Patrik Sivesson It is certified that error appears in the above-identified patent and that said Letters Patent is hereby corrected as shown below:

On the Title Page, at [75], the Inventor's cities of residence should read:

--Suture Östlund, Norrköping (SE);
Patrik Sivesson, Stockholm (SE)--.

Signed and Sealed this

Seventh Day of August, 2007

JON W. DUDAS
*Director of the United States Patent and Trademark Office*